US011011892B2

(12) United States Patent
Kuhnert

(10) Patent No.: US 11,011,892 B2
(45) Date of Patent: May 18, 2021

(54) PRE-CHAMBER SPARK PLUG AND METHOD FOR PRODUCING A PRE-CHAMBER SPARK PLUG

(71) Applicant: DKT VERWALTUNGS-GMBH, Sinsheim (DE)

(72) Inventor: Steffen Kuhnert, Heidelberg (DE)

(73) Assignee: DKT VERWALTUNGS-GMBH, Sinsheim (DE)

( * ) Notice: Subject to any disclaimer, the term of this patent is extended or adjusted under 35 U.S.C. 154(b) by 7 days.

(21) Appl. No.: 16/484,356

(22) PCT Filed: Dec. 18, 2017

(86) PCT No.: PCT/DE2017/200136
§ 371 (c)(1),
(2) Date: Aug. 7, 2019

(87) PCT Pub. No.: WO2018/145681
PCT Pub. Date: Aug. 16, 2018

(65) Prior Publication Data

US 2020/0036166 A1 Jan. 30, 2020

(30) Foreign Application Priority Data

Feb. 8, 2017 (DE) ..... 102017202001.6

(51) Int. Cl.
*H01T 13/54* (2006.01)
*H01T 21/02* (2006.01)
*F02B 19/12* (2006.01)

(52) U.S. Cl.
CPC ..... *H01T 13/54* (2013.01); *H01T 21/02* (2013.01); *F02B 19/12* (2013.01)

(58) Field of Classification Search
CPC ..... H01T 13/54; H01T 21/02; F02B 19/12
See application file for complete search history.

(56) References Cited

U.S. PATENT DOCUMENTS 4,892,070 A * 1/1990 Kuhnert ..... H01T 13/54 123/274
2007/0236122 A1* 10/2007 Borror ..... H01T 13/54 313/118

(Continued)

FOREIGN PATENT DOCUMENTS

DE 3206708 A1 9/1983
DE 3709976 A1 10/1988

(Continued)

*Primary Examiner* — Xiao En Mo
(74) *Attorney, Agent, or Firm* — Jason P. Mueller; FisherBroyles, LLP

(57) ABSTRACT

This disclosure relates to a pre-chamber spark plug including a housing, a ground electrode, a cap enclosing a pre-chamber, and a center electrode inside the pre-chamber, with transfer passages being formed in the cap. Center axes of the transfer passages diverge from a longitudinal direction of the main combustion chamber. A method of manufacturing such a pre-chamber spark plug is also disclosed. The method includes generating a housing, generating a ground electrode, and generating a cap enclosing a pre-chamber and having transfer passages formed in the cap. The method may further include generating a center electrode inside the pre-chamber, such that center axes of the transfer passages diverge from a longitudinal direction of the main combustion chamber. The method further includes generating the cap by a forming process from a raw material wire or from raw material bars. The method may further include compacting a material forming the cap.

16 Claims, 4 Drawing Sheets

(56) References Cited

U.S. PATENT DOCUMENTS

| | | | | |
|---|---|---|---|---|
| 2009/0107436 | A1* | 4/2009 | Schultz | F02B 19/12 123/143 B |
| 2009/0107437 | A1* | 4/2009 | Schultz | H01T 13/50 123/143 B |
| 2011/0215703 | A1* | 9/2011 | Maul | H01T 13/54 313/141 |
| 2013/0206122 | A1* | 8/2013 | Chiera | F02P 15/001 123/594 |
| 2014/0102404 | A1 | 4/2014 | Sotiropoulou et al. | |
| 2014/0261296 | A1* | 9/2014 | Sotiropoulou | F02B 19/1014 123/260 |
| 2015/0059456 | A1* | 3/2015 | Niessner | H01T 13/54 73/114.19 |
| 2016/0053670 | A1* | 2/2016 | Tozzi | F02B 19/12 123/260 |
| 2016/0053671 | A1* | 2/2016 | Sotiropoulou | F02B 19/08 123/260 |
| 2016/0053673 | A1* | 2/2016 | Sotiropoulou | F02B 19/18 123/260 |

FOREIGN PATENT DOCUMENTS

| | | | |
|---|---|---|---|
| DE | 102011076471 | A1 | 11/2012 |
| DE | 102015204814 | B3 | 5/2016 |
| DE | 112015002643 | T5 | 2/2017 |
| EP | 0675272 | A1 | 10/1995 |
| JP | 2015-230744 | A | 12/2015 |
| WO | 2007/092972 | A1 | 8/2007 |

* cited by examiner

PRE-CHAMBER SPARK PLUG AND METHOD FOR PRODUCING A PRE-CHAMBER SPARK PLUG

CROSS-REFERENCE TO EXISTING APPLICATIONS

This application is a national stage entry under 35 U.S.C. 371 of PCT Patent Application No. PCT/DE2017/200136, filed Dec. 18, 2017, which claims priority to German Patent Application No. 10 2017 202 001.6, filed Feb. 8, 2017, the entire contents of each of which are incorporated herein by reference.

This disclosure is directed to a pre-chamber spark plug including a housing, a ground electrode, a cap closing the pre-chamber, and a center electrode arranged inside the pre-chamber, wherein transfer passages are formed in the cap. This disclosure furthermore relates to a method for producing such a pre-chamber spark plug.

A pre-chamber spark plug is known from WO 2007/092972 A1, for example. This spark plug includes a pre-chamber that is provided with a pre-chamber wall and a cover surface. The pre-chamber wall includes a cylindrical portion to which, using rectangular ground electrode carriers, likewise rectangular ground electrodes are attached. Rectangular center electrodes, which are attached to a central center electrode carrier, are assigned to the ground electrodes. In this way, multiple ignition surface pairs are created, by way of which central ignition, to the greatest extent possible, with respect to the pre-chamber is to take place. The pre-chamber wall furthermore includes multiple transfer passages. The transfer passages are designed so as to extend parallel to the longitudinal axis of the pre-chamber or converge. In this way, it is to be achieved that the ignition flares extending through the transfer passages into the main combustion chamber extend parallel to one another or converge.

The problem that arises with the known pre-chamber spark plug is that it is not possible to achieve sufficiently good ignition of the fuel-air mixture due to the arrangement of the transfer passages and the resultant progression of the ignition flares. Moreover, the known pre-chamber spark plug has a complex design. For example, initially a plurality of individual parts has to be manufactured, which additionally have to be joined so as to provide a corresponding pre-chamber spark plug. In addition, the individual parts of the known pre-chamber spark plug have a high manufacturing complexity.

It is therefore the object of the disclosure to configure and refine a pre-chamber spark plug of the type mentioned at the outset in such a way that optimal ignition of the fuel-air mixture is achieved using embodiments that have a simple design and are thus cost-effective to produce. Moreover, a method for producing such a pre-chamber spark plug is to be provided.

According to the disclosure, the above object is achieved by a disclosed embodiment having a pre-chamber spark plug including a housing, a ground electrode, a cap enclosing the pre-chamber, and an ignition electrode arranged inside the pre-chamber. The cap includes transfer passages formed in the cap, such that center axes of the transfer passages diverge from a longitudinal direction of the main combustion chamber.

In a manner according to the disclosure, it was initially found that the ignition properties of a pre-chamber spark plug can be improved in that the center axes of the transfer passages diverge, seen in the direction of the end of the cap facing the main combustion chamber. In other words, the center axes of the transfer passages do not extend parallel to one another, so that the ignition flares entering the main combustion chamber from the transfer passages diverge. In this way, a flow profile and swirl level are generated which result in improved gas exchange and improved combustion in the pre-chamber, as well as in improved ignition in the main combustion chamber. The pre-chamber spark plug according to the disclosure is suitable for use with a stationary gas-fueled engine, for example. Furthermore, it is conceivable that the pre-chamber spark plug according to the disclosure is used in a non-stationary gasoline engine, namely due to the ignition properties achieved by the arrangement of the transfer passages.

In a symmetrical transfer passage, such as a cylindrical passage, the center axis of the transfer passage corresponds to the axis of symmetry of the transfer passage. In the case of an asymmetrical design of the transfer passage, the center axis corresponds to the main propagation direction of the ignition flare extending through the transfer passage. Advantageously, the transfer passages can have a cylindrical design.

It shall be pointed out that, hereafter, when a range is provided, the limit values ending the range are also explicitly part of the indicated range.

Advantageously, 4 to 8 transfer passages can be formed, in a circumferential direction. It has been found that such a number of transfer passages results in optimal ignition by the pre-chamber spark plug. In addition, it is conceivable that a central transfer passage is formed, having a center axis that is arranged on the longitudinal axis of the pre-chamber or extends at least substantially parallel to the longitudinal axis of the pre-chamber.

So as to further optimize the ignition, the center axes of the transfer passages can each extend offset by a distance x from the respective main axis of the pre-chamber. The main axis is the axis which extends parallel to the center axis of the transfer passage and intersects the longitudinal axis of the pre-chamber. The longitudinal axis of the pre-chamber corresponds to the axis of symmetry of the pre-chamber in the case of a symmetrical pre-chamber. In the case of an asymmetrical pre-chamber, the longitudinal axis corresponds to the center axis of the pre-chamber. Consequently, the transfer passages extend tangentially with respect to the outside diameter of the cap, not radially. This design measure generates a flow profile or swirl level ideal for the ignition in the main combustion chamber.

Advantageously, the ratio $$\frac{x_i}{D}$$

of the distance $x_i$ between the center axis of a transfer passage i and the main axis of the pre-chamber to the largest inside diameter D of the cap in each case is in the range of 0.04 to 0.40. In further embodiments, the ratio may be from approximately 0.05 to approximately 0.35, or the ratio may be from approximately 0.06 to approximately 0.30.

According to an advantageous embodiment, the ratio of $$\frac{A}{D}$$

the total cross-sectional surface area A of all transfer passages to the largest inside diameter D of the cap can be in a range from approximately 0.40 mm to approximately 0.95 mm, or may be in a rage from approximately 0.45 mm to approximate 0.80 mm. For a number of n circular cylindrical transfer passages, the total cross-sectional surface area is calculated according to $$A = \sum_{i=1}^{n} \frac{\pi}{4} d_i^2.$$

In an accordingly implemented pre-chamber spark plug, a flow profile that is improved for the gas exchange is generated.

So as to further optimize the flow profile and the swirl level, the opening angle α defined by the center axes of the transfer passages can be in the range of 100° to 160°.

In a further advantageous manner, the material forming the cap can include a mass fraction of nickel of more than 99% or can be produced from a nickel alloy including fractions made of iron, cobalt and chromium. Such a design has the advantage that the cap is heat-resistant and corrosion-resistant and exhibits good thermal conductivity. The term 'mass fraction' denotes the value of the quotient from the mass of the nickel and overall mass of the cap.

In an advantageous manner, the material forming the cap can be compacted on the inside of the cap, at least in the region of the transfer passages. This measure presents cracking in this region of the cap, which is subjected to high stresses. Furthermore, it is conceivable for the entire surface of the inside of the cap to include an accordingly compacted material.

The underlying object is furthermore achieved by the method of the other independent claim 9. According to this claim, a method for producing a cap for a pre-chamber spark plug according to any one of claims 1 to 8 is provided, wherein the cap is produced from a raw material wire or from a raw material bar in a forming process.

In a manner according to the disclosure, it has been found that a pre-chamber spark plug according to the disclosure can be easily and cost-effectively produced by producing the cap by way of a forming process. Furthermore, it has been found that the cap is produced in a material-saving manner by the method according to the disclosure. The forming process may include impact extrusion or deep drawing. The cap thus produced can be joined, and may be welded, to the housing of the pre-chamber spark plug. For example, the cap can be welded to the housing by way of a vacuum welding process. The welding is carried out in an underpressure environment using underpressure of less than 50 mbar, and in an appropriate chamber. As an alternative, it is conceivable for the cap to be joined to the housing by way of tungsten inert gas welding, plasma arc welding, laser welding or electron beam welding.

Advantageously, the transfer passages can be produced by way of a machining process, for example by way of boring. When using boring, the center axes and diameters of the transfer passages can be produced in a simple and precise manner.

So as to prevent cracking as a result of the high stress, the material forming the cap can be compacted on the inside of the cap, at least in the region of the transfer passages subject to high stresses. Advantageously, the material can be compacted by way of sand blasting or shot peening. This has the further advantage that the transfer passages are also deburred by the sand blasting or shot peening, which positively impacts the ignition properties and durability of the pre-chamber spark plug. In a simple and effective manner, the material of the cap can be compacted accordingly on the entire inner side.

Various possibilities are available for advantageously designing and refining the teaching of the disclosure. For this, reference is made to the claims dependent on claim 1 on the one hand, and to the description below of example embodiments of the disclosure based on the drawings on the other hand. Generally various embodiments and refinements of the teaching are also described in conjunction with the following drawings:

Figure 1:
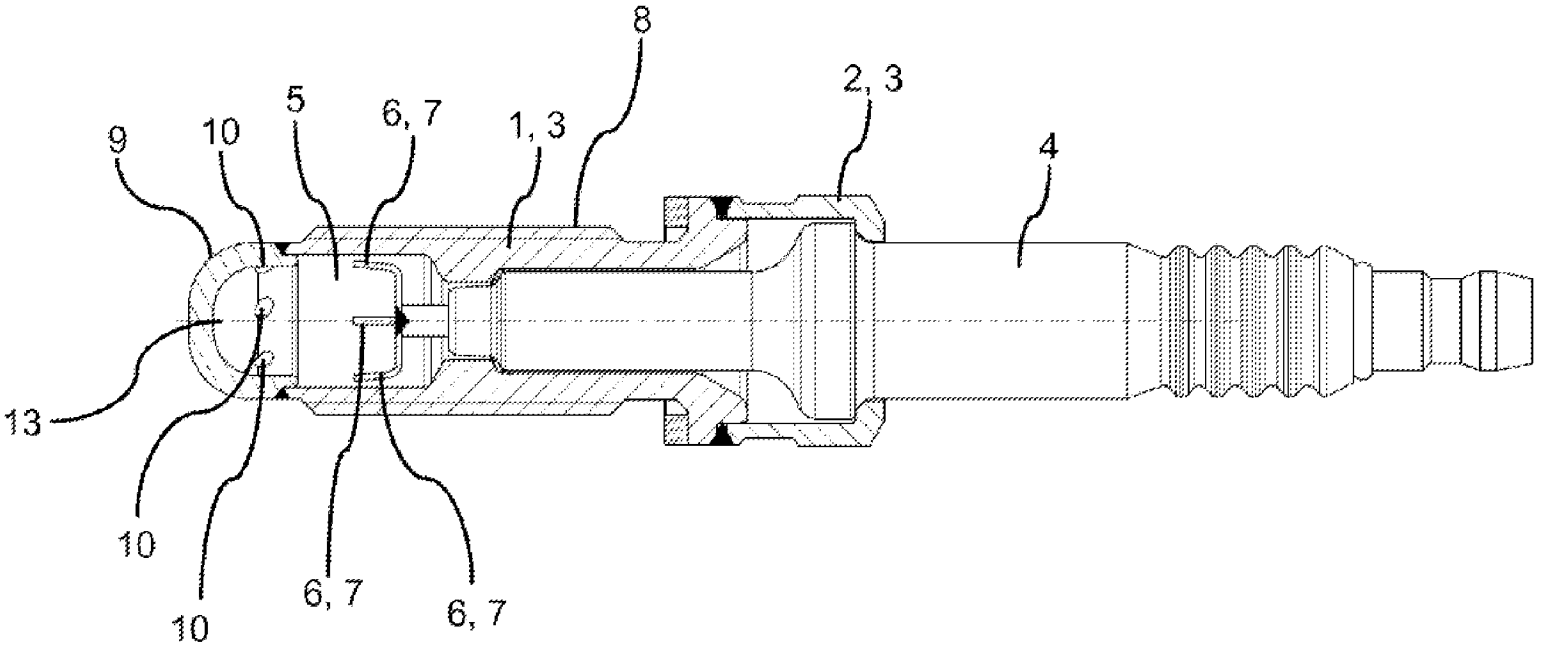
FIG. 1 shows an exemplary embodiment of a pre-chamber spark plug according to the disclosure in a schematic, partially cut illustration.
Figure 2:
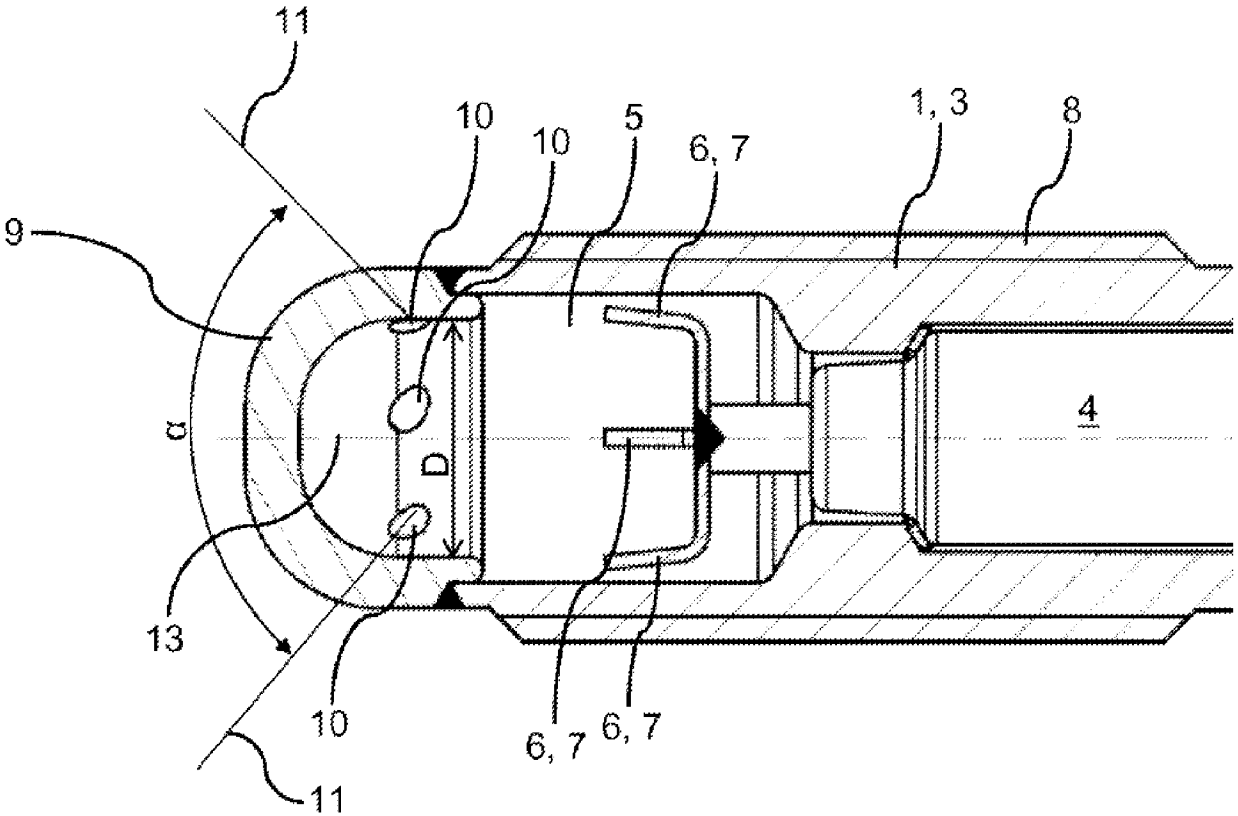
FIG. 2 shows an enlarged illustration of a detail from FIG. 1.

FIGS. 1 and 2 show an exemplary embodiment of a pre-chamber spark plug according to the disclosure in a schematic, partially cut illustration. The pre-chamber spark plug includes a housing 3 formed of a first housing part 1 and a second housing part 2. The housing parts 1, 2 are connected to one another by a weld seam. The housing 1 surrounds a portion of an insulator 4. A supply line, which is not shown, is arranged inside the insulator 4 and supplies the center electrode 6 provided inside the pre-chamber 5 with voltage. The center electrode 6 includes a total of four electrode arms 7. However, the center electrode 6 can also have a different geometry.

In the exemplary embodiment shown here, the first housing part 1 serves as a ground electrode and includes an external thread 8 for screwing the pre-chamber spark plug into a housing cover of the main combustion chamber. The pre-chamber 5 is closed by the cap 9 in the direction of the main combustion chamber. In the exemplary embodiment shown here, the cap 9 is welded to the first housing part 1. It is conceivable for the cap 9 to extend up to the center electrode 6 and to serve as the ground electrode. The cap 9 includes multiple transfer passages 10, which are arranged around the cap 9 in the circumferential direction. FIG. 2 shows the center axes 11 of two transfer passages 10. The center axes 11 diverge, seen in the direction of the main combustion chamber. This tangential arrangement of the transfer passages 10 generates a flow profile and a swirl level which are optimal for the combustion in the pre-chamber 5 and for the ignition in the main combustion chamber.

FIG. 2 shows the opening angle α defined by the main axes of the transfer passages 10. The opening angle α is may be in a range from approximately 100° to approximately 160°. Furthermore, the largest inside diameter D of the pre-chamber 5 is shown.

Figure 3:
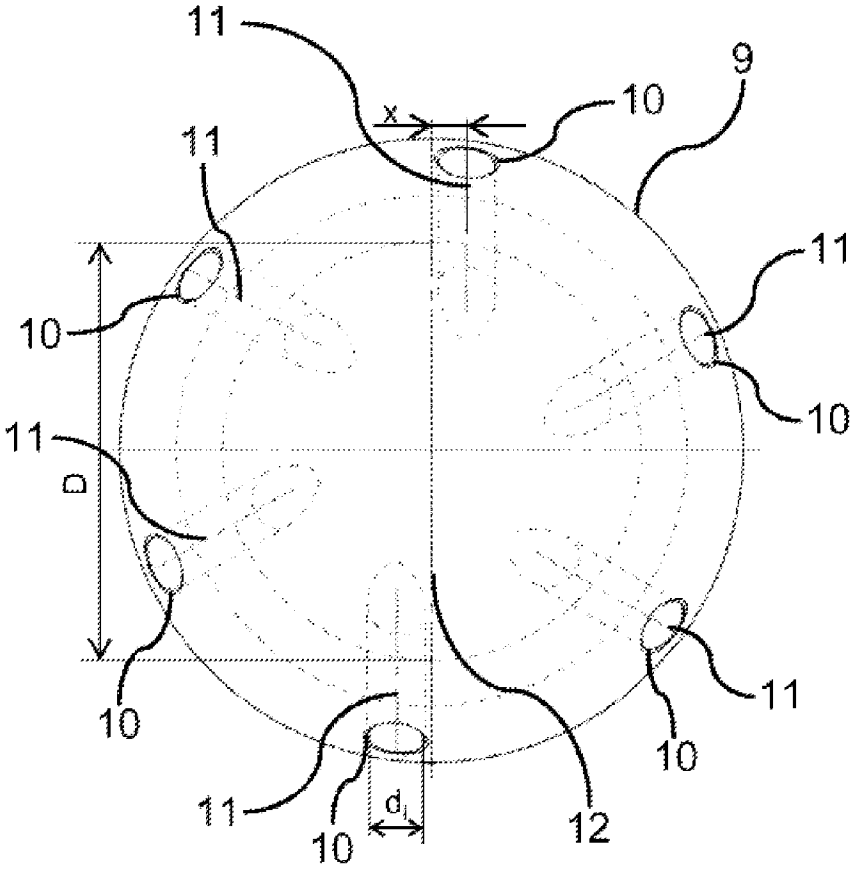
FIG. 3 shows a section through the cap of a pre-chamber spark plug according to the disclosure in a schematic illustration.

FIG. 3 shows a section through the pre-chamber 5 of a pre-chamber spark plug according to the disclosure in a schematic illustration. It is clearly apparent that the center axes 11 of the transfer passages 10 are each arranged offset by a distance x from the respective main axis 12. The main axis 12 corresponding to a center axis 11 is defined by the straight line that extends parallel to the center axis 11 of a transfer passage 10 and intersects the longitudinal axis 13 of the pre-chamber. FIG. 3 furthermore shows the diameter $d_i$ of a transfer passage 10.

Figure 4:
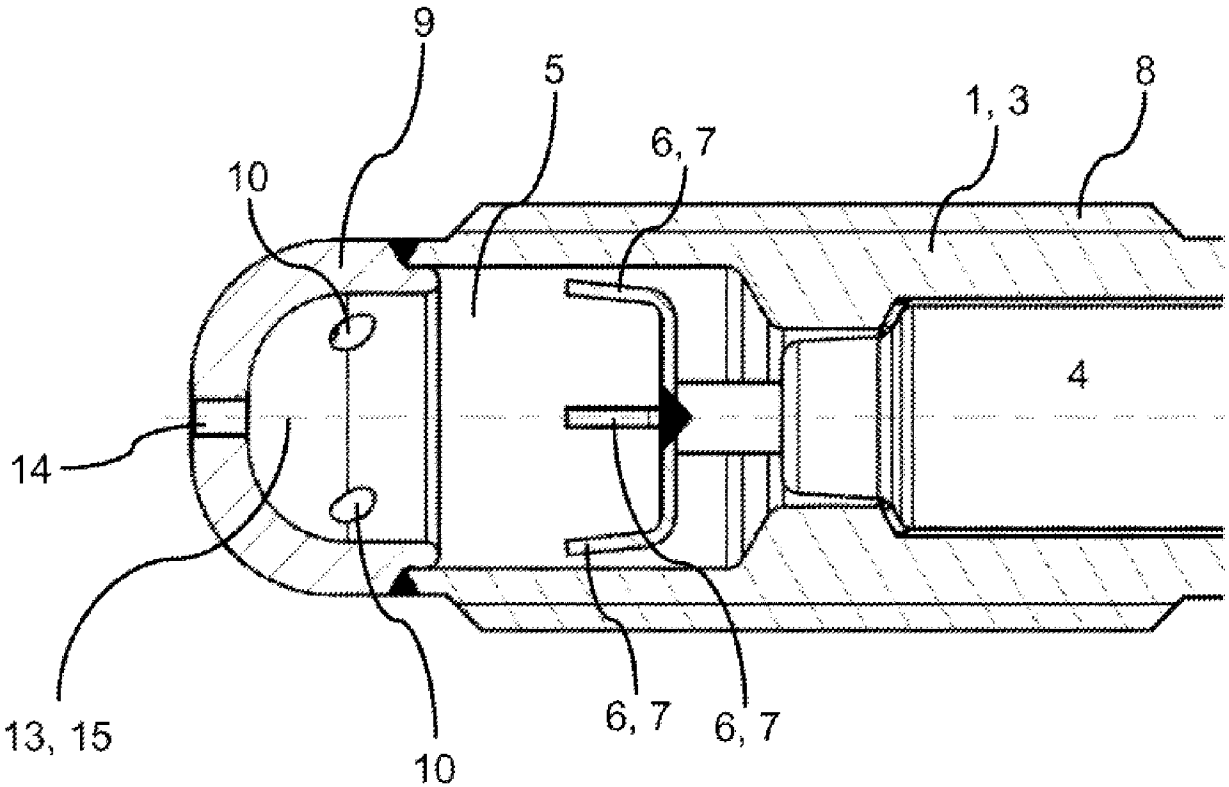
FIG. 4 shows a portion of a further pre-chamber spark plug according to the disclosure in a schematic, partially cut illustration.

FIG. 4 shows another exemplary embodiment of a pre-chamber spark plug according to the disclosure. The pre-chamber spark plug according to FIG. 4 corresponds to the exemplary embodiment shown in FIGS. 1 and 2, wherein additionally a central transfer passage 14 is formed. The center axis 15 of the central transfer passage 12 extends on the longitudinal axis 13 of the pre-chamber 5. The further transfer passage 12 optimizes the ignition properties of the pre-chamber spark plug yet again. So as to avoid repetitions, reference is moreover made to the comments made regarding FIGS. 1 to 3, which apply analogously to the exemplary embodiment shown in FIG. 4.

With respect to further advantageous embodiments of the device according to the disclosure and of the method according to the disclosure, reference is made to the general part of the description and to the accompanying drawings so as to avoid repetitions.

Finally, it shall be expressly pointed out that the above-described exemplary embodiments of the device according to the disclosure and of the method according to the disclosure serve only to explain the claimed teaching, but do not limit the disclosure to the exemplary embodiments.

LIST OF REFERENCE NUMERALS

1 first housing part
2 second housing part
3 housing
4 insulator
5 pre-chamber
6 center electrode
7 electrode arm
8 external thread
9 cap
10 transfer passage
11 center axis
12 main axis
13 longitudinal axis
14 central transfer passage
15 center axis

The invention claimed is:

1. A pre-chamber spark plug, comprising:
a housing;
a ground electrode;
a cap enclosing a pre-chamber and having transfer passages formed in the cap; and
a center electrode inside the pre-chamber,
wherein center axes of the transfer passages diverge from a longitudinal direction of the main combustion chamber, and
wherein a ratio A/D of a total cross-sectional surface area A, of all transfer passages, to a largest inside diameter D of the cap is in a range from approximately 0.40 mm to approximately 0.95 mm.

2. The pre-chamber spark plug according to claim 1, wherein the transfer passages include 4 to 8 transfer passages.

3. The pre-chamber spark plug according to claim 1, wherein the center axes of the transfer passages are offset by a distance x from a main axis of the pre-chamber.

4. The pre-chamber spark plug according to claim 3, wherein a ratio x/D, of the distance x between a center axis of a transfer passage and the main axis of the pre-chamber, to a largest inside diameter D of the cap is in a range from approximately 0.04 to approximately 0.40.

5. The pre-chamber spark plug according to claim 1, wherein an opening angle $\alpha$ defined by the center axes of the transfer passages is in a range from approximately 100° to approximately 160°.

6. The pre-chamber spark plug according to claim 1, wherein the cap includes a material having a mass fraction of more than 99% nickel or includes a nickel alloy having fractions of iron, cobalt, and chromium.

7. The pre-chamber spark plug according to claim 1, wherein a material forming the cap is compacted on an inside of the cap, at least in a region that includes the transfer passages.

8. A method of manufacturing a pre-chamber spark plug, the method comprising:
generating a housing;
generating a ground electrode;
generating a cap enclosing a pre-chamber and having transfer passages formed in the cap; and
generating a center electrode inside the pre-chamber,
wherein center axes of the transfer passages diverge from a longitudinal direction of the main combustion chamber,
wherein the cap is generated by a forming process from a raw material wire or from raw material bars, and
wherein a ratio A/D of a total cross-sectional surface area A, of all transfer passages, to a largest inside diameter D of the cap is in a range from approximately 0.40 mm to approximately 0.95 mm.

9. The method according to claim 8, wherein the forming process includes impact extrusion or deep drawing.

10. The method according to claim 8, wherein at least one transfer passage is generated in the cap by a machining process.

11. The method according to claim 10, further comprising compacting a material forming the cap on an inside of the cap, at least in a region that includes the transfer passages.

12. The pre-chamber spark plug according to claim 4, wherein the ratio x/D is in a rage from approximately 0.05 to approximately 0.35.

13. The pre-chamber spark plug according to claim 4, wherein the ratio x/D is in a rage from approximately 0.06 to approximately 0.30.

14. The pre-chamber spark plug according to claim 1, wherein the ratio A/D is in a rage from approximately 0.45 mm to approximately 0.80 mm.

15. The pre-chamber spark plug according to claim 10, wherein the machining process includes boring.

16. The pre-chamber spark plug according to claim 11, wherein compacting further comprises sand blasting or shot peening.

* * * * *